US009074392B2

(12) United States Patent
Berger

(10) Patent No.: US 9,074,392 B2
(45) Date of Patent: Jul. 7, 2015

(54) MULTI-POINT EXIT DOOR LOCK AND METHOD OF INSTALLATION

(75) Inventor: Mark J. Berger, New York, NY (US)

(73) Assignee: SECURITECH GROUP, INC., Maspeth, NY (US)

( * ) Notice: Subject to any disclaimer, the term of this patent is extended or adjusted under 35 U.S.C. 154(b) by 2212 days.

(21) Appl. No.: 11/804,303

(22) Filed: May 16, 2007

(65) Prior Publication Data

US 2007/0273158 A1 Nov. 29, 2007

Related U.S. Application Data

(60) Provisional application No. 60/800,969, filed on May 16, 2006.

(51) Int. Cl.

| | |
|---|---|
| ***E05C 9/00*** | (2006.01) |
| ***E05B 65/10*** | (2006.01) |
| ***E05B 53/00*** | (2006.01) |
| *E05C 9/10* | (2006.01) |

(52) U.S. Cl.
CPC ..... *E05B 65/1073* (2013.01); *E05B 53/003* (2013.01)

(58) Field of Classification Search
USPC ..... 292/32, 37, 38, 40, 42, 92, 175
See application file for complete search history.

(56) References Cited

U.S. PATENT DOCUMENTS

| | | | | |
|---|---|---|---|---|
| 536,957 | A * | 4/1895 | Klein | 70/109 |
| 1,006,211 | A | 10/1911 | Hermon | |
| 1,094,677 | A | 4/1914 | Page | |
| 1,282,320 | A | 10/1918 | Timlin et al. | |
| 1,529,865 | A * | 3/1925 | Bolles | 292/92 |
| 1,552,690 | A | 9/1925 | Frantz | |
| 2,147,581 | A * | 2/1939 | Prinzler | 292/92 |
| 2,862,302 | A | 12/1958 | Lucia | |
| 2,968,506 | A | 1/1961 | Lade | |
| 3,584,905 | A * | 6/1971 | Emenaker | 292/38 |
| 3,683,652 | A * | 8/1972 | Halopoff et al. | 70/467 |
| 4,012,066 | A * | 3/1977 | Salvatore | 292/341.13 |
| 4,199,176 | A * | 4/1980 | Kelly | 292/38 |
| 4,387,917 | A * | 6/1983 | Cocker | 292/40 |
| 4,461,160 | A * | 7/1984 | Van Gompel | 70/100 |
| 4,466,676 | A * | 8/1984 | Nilsson | 312/283 |
| 4,892,338 | A * | 1/1990 | Weinerman et al. | 292/35 |
| 5,118,151 | A | 6/1992 | Nicholas et al. | |
| 5,209,168 | A * | 5/1993 | Chapron et al. | 109/59 T |
| 5,290,077 | A | 3/1994 | Fleming | |
| 6,000,733 | A * | 12/1999 | Linder | 292/92 |
| 6,006,560 | A * | 12/1999 | DeVries | 70/208 |
| 6,309,008 | B1 * | 10/2001 | Bacon | 296/106 |

(Continued)

*Primary Examiner* — Carlos Lugo
(74) *Attorney, Agent, or Firm* — Abelman, Frayne & Schwab

(57) ABSTRACT

A multi-point exit door lock and method of installing same, the door lock including main lock and upper and lower lock modules. a push type panic bar, lock bolts associated with each of the lock modules, and a pull-type cable of predetermined length having its ends fixed to the main lock module and to each of the upper and lower lock modules, whereby pushing the panic bar opens all lock modules. The method of installing the new lock includes a template which is temporarily mounted to the exit door and rotated to successive positions for automatically and accurately marking all the drill holes for mounting all the lock modules at relative distances apart corresponding to the predetermined distances between them pre-established by the cables of predetermined length fixedly attached to the various lock modules.

20 Claims, 7 Drawing Sheets

(56) References Cited

U.S. PATENT DOCUMENTS

Figure 2:
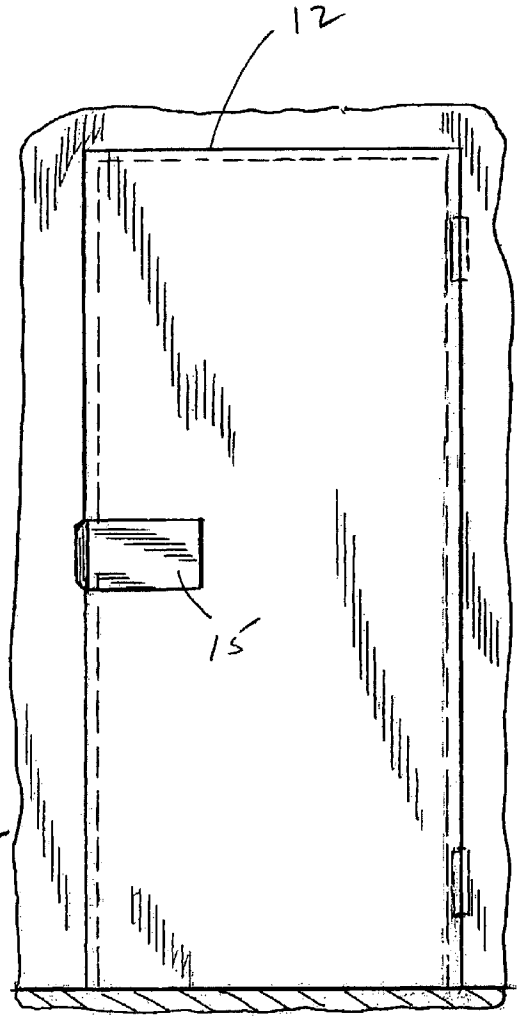

| | | | | |
|---|---|---|---|---|
| 6,820,905 | B1 | 11/2004 | Haeck et al. | |
| 7,040,675 | B1 * | 5/2006 | Ott et al. | 292/216 |
| 7,070,215 | B2 * | 7/2006 | Kelley et al. | 292/241 |
| 7,152,889 | B2 * | 12/2006 | Jeffries | 292/215 |
| 7,343,762 | B1 * | 3/2008 | East et al. | 70/224 |
| 7,784,841 | B2 * | 8/2010 | Watson et al. | 292/336.3 |
| 7,788,954 | B2 * | 9/2010 | Schumm | 70/107 |
| 2003/0111845 | A1 * | 6/2003 | Sadler | 292/35 |
| 2007/0080541 | A1 * | 4/2007 | Fleming | 292/35 |

* cited by examiner

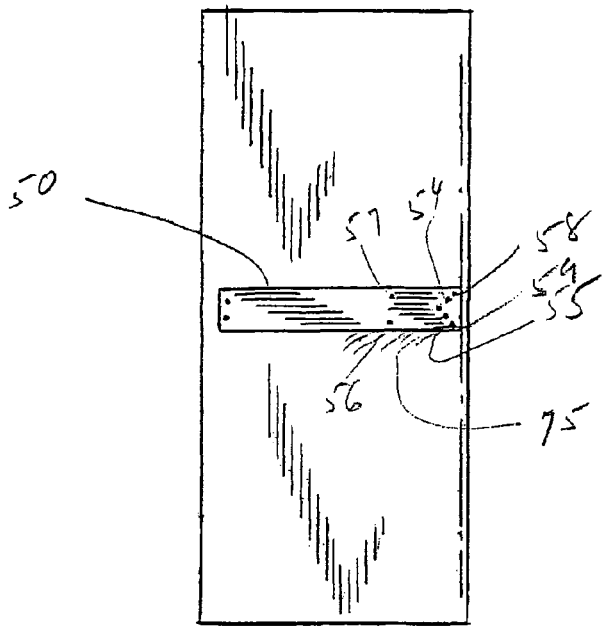
6e FIG. 13
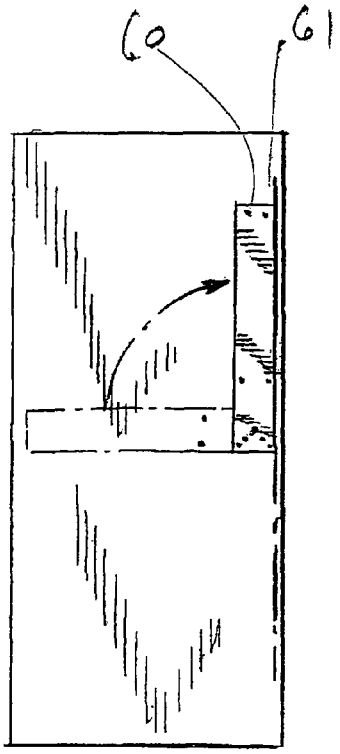
6f FIG. 14
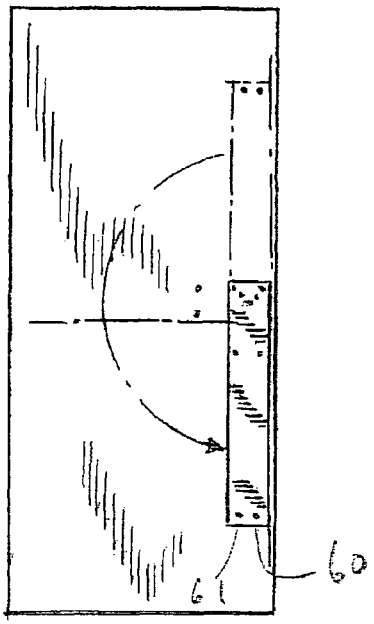
6g FIG. 15
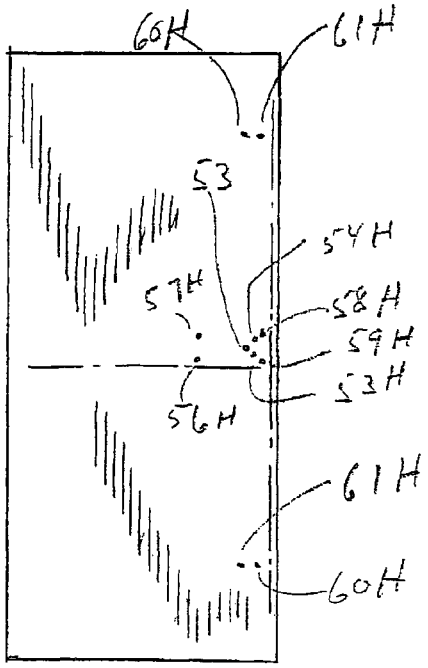
FIG. 16

FIG. 17
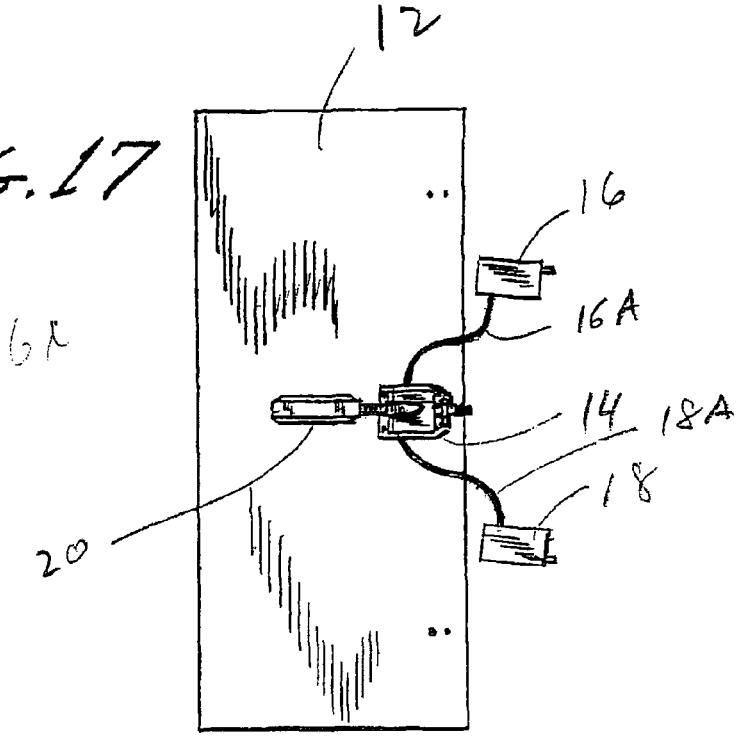
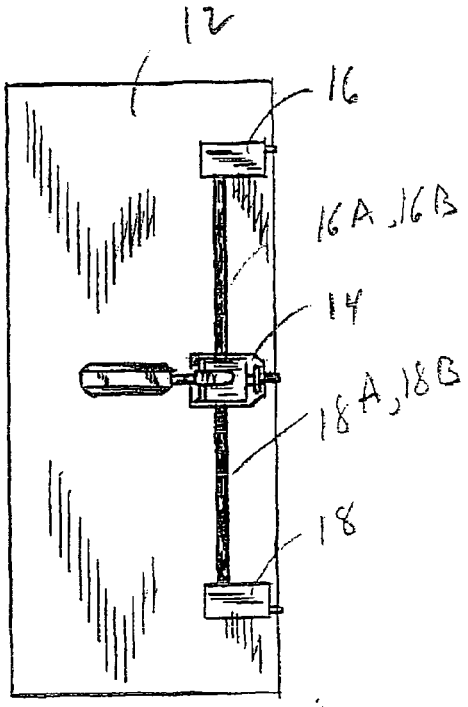
FIG. 18
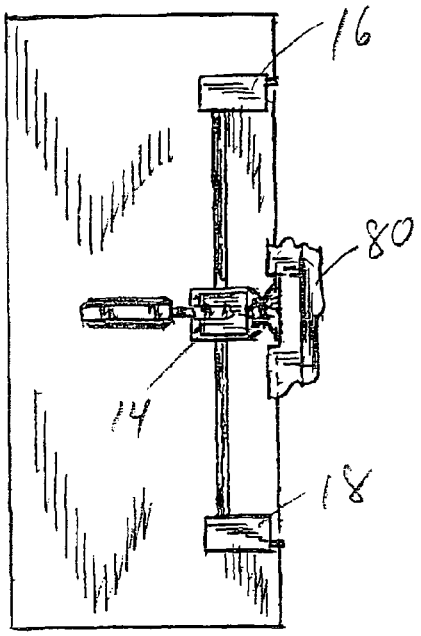
FIG. 19

MULTI-POINT EXIT DOOR LOCK AND METHOD OF INSTALLATION

RELATED PATENT APPLICATION

This application claims priority under 35 U.S.C. 119, 120 based upon applicant's Provisional Patent Application Ser. No. 60/800,969 filing date of May 16, 2006.

A. BACKGROUND OF THE INVENTION

1. Field of the Invention

This invention relates to security locks and lock systems for exit doors and particularly lock systems for doors having lock bolts and a lock releasing a paddle or a panic bar that moves in a direction generally perpendicular to the plane of the door.

2. Related Prior Art Patents

U.S. Pat. No. 1,552,690; U.S. Pat. No. 1,006,211; U.S. Pat. No. 1,094,677; U.S. Pat. No. 1,282,320; U.S. Pat. No. 2,862,302; U.S. Pat. No. 2,968,506; U.S. Pat. No. 5,118,151; U.S. Pat. No. 5,290,077; and U.S. Pat. No. 6,820,905.

3. Background and Prior Art

The prior art includes locking systems specifically for exit doors that open outward usually with a push-out type panic bar that releases or withdraws one or more lock bolts, and other more general locking systems for doors and windows, such as latch mechanisms which are spring loaded and allow the door or window to close and lock automatically and have no provision for emergency exit by merely pushing an otherwise securely locked door.

Within these two locking systems are those which are custom designed to be made at the time the door is made and thus closely conform to structural peculiarities of each particular door, in contrast to a universal type of locking system which comprises components mountable to essentially any door along its locking edge remote from its hinge edge.

This invention is concerned (a) with door locking systems of the first mentioned type which allow a user to simply press the panic bar paddle in a direction generally perpendicular to the plane of the doors which thereafter automatically withdraws deadbolts from their locked position at different points of the multi-point locking system, and (b) with door locks that can be installed on most typical exit doors that are already made and hung in a door frame.

In typical multipoint exit door lock systems there is either (a) a single long lock assembly comprising a central lock plus upper and lower locks coupled together by push rods, which is a large and awkward component, or (b) a central lock near the center of the door and mounted along the locking edge thereto, and separate upper and lower locks mounted along same locking edge of the door above and below the central lock. Thereafter, there are installed drive rods or push rods extending from the central lock to each of the remote upper and lower locks, so that actuation of the central lock to release its lock bolt, will automatically, via the push rods, release the lock bolts of the upper and lower locks at the same time. In order for the three locks to work simultaneously and fluidly and correctly, the upper and lower locks have to be positioned and located with considerable accuracy which includes marking, drilling and finally, bolting or screwing these components onto the door. The present invention substantially prevents errors in measuring, orientation of holes, drilling and/or final installation that could contribute to failure of the door to securely lock or difficulty or inability to open the door in an emergency situation.

Prior art exit door locking systems and components thereof are capable of operating well and reliably; however, for such result they must be installed very accurately which often does not happen at the time of "initial" installation. Faulty installation may be discovered:

(a) during an early inspection before the lock is operated in a real emergency exit situation, (b) when a person is trying to exit a building in an emergency, or (c) after a burglar has broken in or successfully defeated the lock or compromised the door. All these situations require further labor, time and expense for correction.

Even before there are operational problems, there is an extremely serious economic problem, namely the excessive time required for many persons to install such lock systems. If the time required is excessive, the profitability of the original sale is compromised, or else, the price must be raised to cover such slow installation. This "installation time" problem exists for skilled professional installers and even more so for non-trained persons who nevertheless perform the installation.

In connection with all the above-described problems, industry records indicate a very large number of initially defective installation and/or excessive times spent on installation. Thus, there are serious security and emergency exit issues regarding doors that are supposed to represent safety and security, and significant economic issues regarding the installations of these door lock systems.

A still further issue is the lock or lock system itself and the components which include relatively heavy, bulky and expensive rigid push rods between and connecting locks.

The present invention addresses all of the above-discussed issues and provides new, unusual and very valuable solutions.

B. OBJECTS AND SUMMARY OF THE NEW INVENTION

The present invention pertains to a new exit door multipoint lock and to a new installation method for such a lock. Typical exit doors open outward and have the lock mechanism on the inside surface, the lock including a panic bar or paddle that can be pushed in a direction generally perpendicular to the plane of the door and thus in the same outward direction of opening the door. Obviously, it is critically important that the lock release components of this lock mechanism operate easily and reliably for emergency exit structures, and still lock easily and securely in all other situations.

A first object of this invention is to provide a new exit door lock that can be manufactured at a reasonable cost, that is strong and reliable in operation, and that can be installed more easily and more quickly than prior exit door locks.

A further object of this invention is to provide a lock whose main or central lock module and top and bottom lock modules are permanently coupled together at the factory, so that they do not have to be assembled together "on site" where the installation of the lock on the door occurs. Thus, the number of separate parts is reduced, the time and skill for assembly is greatly reduced, and the likelihood of error in assembly and installation is greatly reduced. The remote lock bolts may be directed transversely or vertically, or in some combination.

An additional object of this invention is to replace the push or drive rods operating between the central and the top and bottom lock modules with high strength cables whose ends are fixed to the modules and protected and concealed from tampering. These cables, when extended in straight lines, automatically establish the correct predetermined distance between modules, and serve their purpose with less weight than prior push rods, and reduce the overall weight and bulk of the lock in regard to packing, storing, shipping, handling and installation.

Another object of this invention is to employ a motion translation member ("MTM") which converts the axially inward motion of the panic bar into rotary motion that pulls and withdraw the dead bolt associated with the main lock module, and pulls and draws additional bolts associated with the top and bottom lock modules respectively to unlock all lock modules. In one typical MTM there is a shaft with an outside surface helical thread, and a plate with mating threads, such that pressure via the panic bar on the plate in the axial direction of the bolt causes the plate to rotate. Pins near the circumference of the plate rotate as the plate rotates, and each pin is coupled by a link to one of said lock bolts, for withdrawing the bolt from its respective strike plate or other recess, when the panic bar is pushed.

In the lock mechanism as described, the lock bolts of the main, top and bottom lock modules move laterally in a plane generally parallel to the plane of the door when the panic bar is pushed in a direction generally perpendicular to the plane of the door.

Concurrent with the development of this new lock with its fixed length cables having fixed end connections coupling the top and bottom lock modules to the main lock module, is the invention of a new method of installation of such a lock, the new method being more accurate, less expensive, and being usable by persons with little or no professional lock installation experience. Details of the new method are described and illustrated below, but in partial summary, the new method utilizes a special marking template that almost automatically and without possibility of error results in marking the drill hole locations for all three lock modules, so that when they are bolted onto the door, the connecting cables will be in the correct straight line configuration and tautness, and all three lock bolts will withdraw smoothly and correctly when the panic bar is pushed. In this new method of installation it is possible to use a single template which is rotated about a fixed pivot point to three different positions to automatically and accurately establish markings for all the mounting holes for main, upper and lower lock modules. The new method thus eliminates numerous potential sources of error during installation, and reduces the time and cost required for installation, and eliminates the many "call-backs" required for repair persons to adjust, fix or even re-install exit door locks.

In addition to the advantages resulting from using this new lock assembly and using this new method of installation, there is the further benefit that the locking assembly can be essentially fully assembled in the factory, since the connecting cables are permanently attached to the central and remote lock modules to establish the pre-determined fixed distance between them as earlier discussed. This means there will be fewer individual components for the installer to locate, identify, orientate, attach and obviously fewer potential errors for the installer. In addition to all these benefits, there will be a significant saving in time since the installer is no longer required to do many of the above listed steps.

Most importantly, is the fact that a non-professionally trained installer can, with this new assembly combined with this new method of installation, quickly, easily and accurately install a serious security lock and locking system.

Each of the lock modules utilizes known technology for the module housing, the axially moving locking bolt, the motion translation member component and the panic bar. What is significantly new and different herein from conventional multi-point exit door security lock systems is the combination of using cables between lock modules to transmit force in a pulling mode as opposed to rigid rods to transmit force in a pushing mode, said cables being combined with the fact that they have their ends permanently fixed to said modules to establish a predetermined fixed distance between them for ease, accuracy and speed in the later installation process.

A further feature and advantage in the new system pertains to prior art systems having a multiplicity of components for an installer to identify, organize, orient, attach and adjust. In the new system most of these steps are accomplished in advance of delivery to the installer.

When considering the above-described objects, one preferred embodiment of the new invention is defined as a multi-point lock adapted to be mounted on an exit door that is adapted to be mounted on a door frame, where said exit door is movable from its closed position to its open position, said lock comprising:

a. a main lock module and first and second remote lock modules, each of said lock modules having a housing, a lock bolt movable in its housing, and drive means to move said lock bolt between its closed and open positions, each of said lock bolts having an end part for locking engagement with said door frame, b. two pull-type cables, each having near and remote ends where said near of each cable is permanently fixed to said main lock drive means and said remote end of each cable is permanently fixed to one of said remote lock drive means, each of said cables having a predetermined length such that there will be a corresponding predetermined distance between said main and said two remote lock modules when said multi-point lock is mounted on an exit door with said cables extended in a generally straight and taut configuration, c. said main lock module further comprising an activation element coupled to said main lock drive means and movable between its closed and open positions, d. whereby, in said multi-point lock, when mounted on an exit door with said cables extended and said lock bolts in their locked positions engaged to said door frame, movement of said activation means from its closed to its open position moves said main lock drive means which simultaneously (a) moves said main lock bolt to its open position, and (b) applies tension to both of said cables which causes said two remote drive means to move their remote lock bolts to move to their respective open positions, so that said exit door can open.

A further preferred embodiment of this invention is a method of installation of a lock as generally defined above. Such method includes the steps where said exit door will have sets of mounting holes respectively for said main and remote lock modules which sets are spaced apart distances corresponding to said predetermined lengths of said cables when they are extended straight, comprising the steps:

a. providing a marking template in the form of a plate having near and remote ends, said template having at or inward of said near end a pivot point, and having: (a) in the vicinity of said pivot point a pattern of holes corresponding to a pattern of holes required for mounting said main lock module to said exit door, and (b) in the vicinity of said remote end a pattern of holes corresponding to a pattern of holes required for mounting said remote lock modules to said exit door, b. establishing a pivot point on said inner surface of said exit door at an elevation and distance from the edge of the door corresponding the desired location of said main lock module, c. temporarily pivotally securing said template via its pivot point onto said exit door at its pivot point, d. in any selected sequence performing the following steps (1), (2), (3):

(1) positioning said template generally vertically upward and marking via said template mounting holes for one of said remote lock modules and then drilling said mounting holes in said exit door, (2) positioning said template generally vertically downward and marking via said template mounting holes for the other of said remote lock modules and then drilling said mounting holes in said exit door, and (3) positioning said template generally horizontally and marking via said template and then drilling said mounting holes for said main lock module, e. removing said template from said exit door, f. positioning said main and remote lock modules to overlie said respective mounting holes therefor and then securing said lock modules to said exit door by fastening means joining said lock modules to their respective mounting holes.

Said invention can be further defined as a method for rapid installation on an inside surface of an exit door of a multi-point lock, comprising the steps:

a. providing a multi-point lock comprising a main lock module and upper and lower modules each of which is coupled to said main lock module by a pull-type cable of predetermined length which establishes a predetermined distance between said main and remote lock modules when said cables are extended in a generally straight configuration, b. establishing on said inside surface of said exit door a pivot point that is intermediate the top and bottom of the door and near the locking edge of said door, c. employing a template having opposite ends, a pivot point near one end and a pattern of holes at the other end, to mark said exit door for a pattern of mounting holes for said remote lock modules said predetermined distance from said pivot point, positioning said main and remote lock modules adjacent their respective mounting hole patterns and with said cables extended axially, and attaching said lock modules via said hole patterns to said exit door.

While the new invention disclosed herein will be most commonly applied to exit doors that are pivoted outward about a vertical axis, the invention may also be applied to exit doors which slide horizontally or vertically relative to the door frame. Furthermore, the new lock assembly may be mounted within a door structure as opposed to being mounted on an exposed surface.

The above-described and other advantages of the invention will be further understood and appreciated by those skilled in the art by reference to the following written specification, claims and appended drawings.

C. BRIEF DESCRIPTION OF THE DRAWINGS

Figure 1:
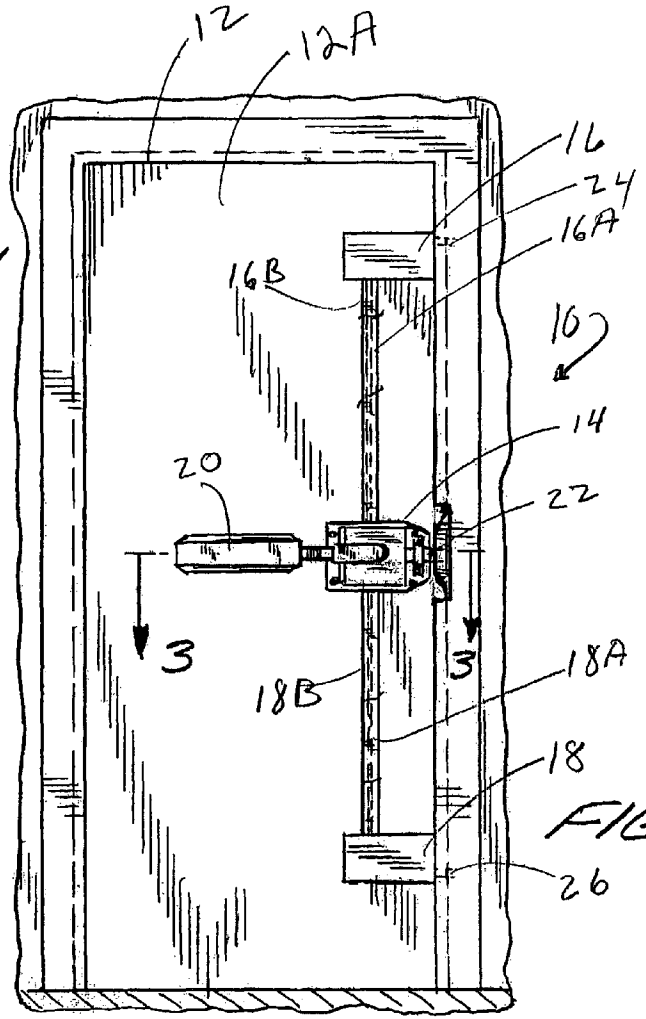
Figures 3, 4:
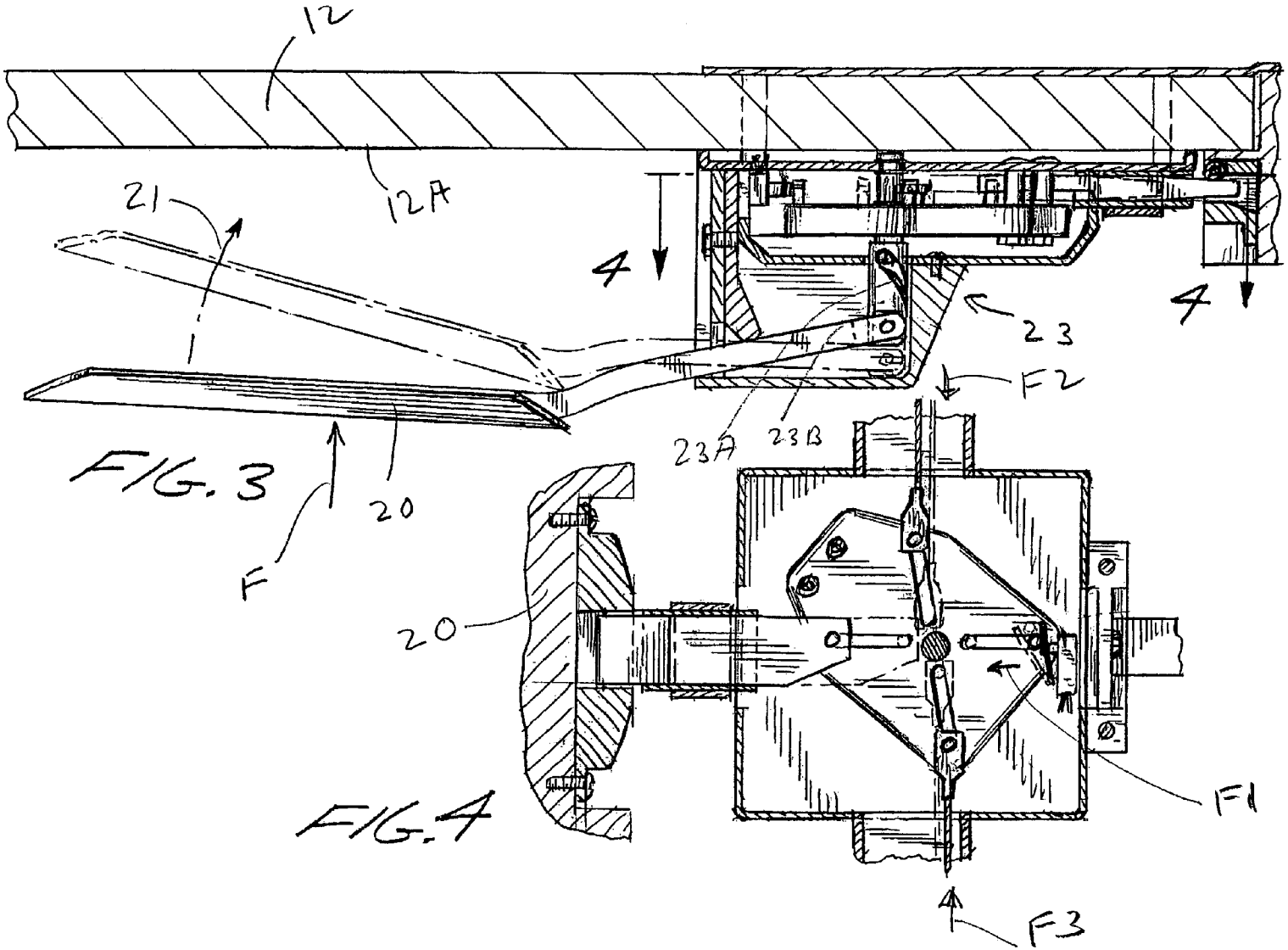
Figure 5:
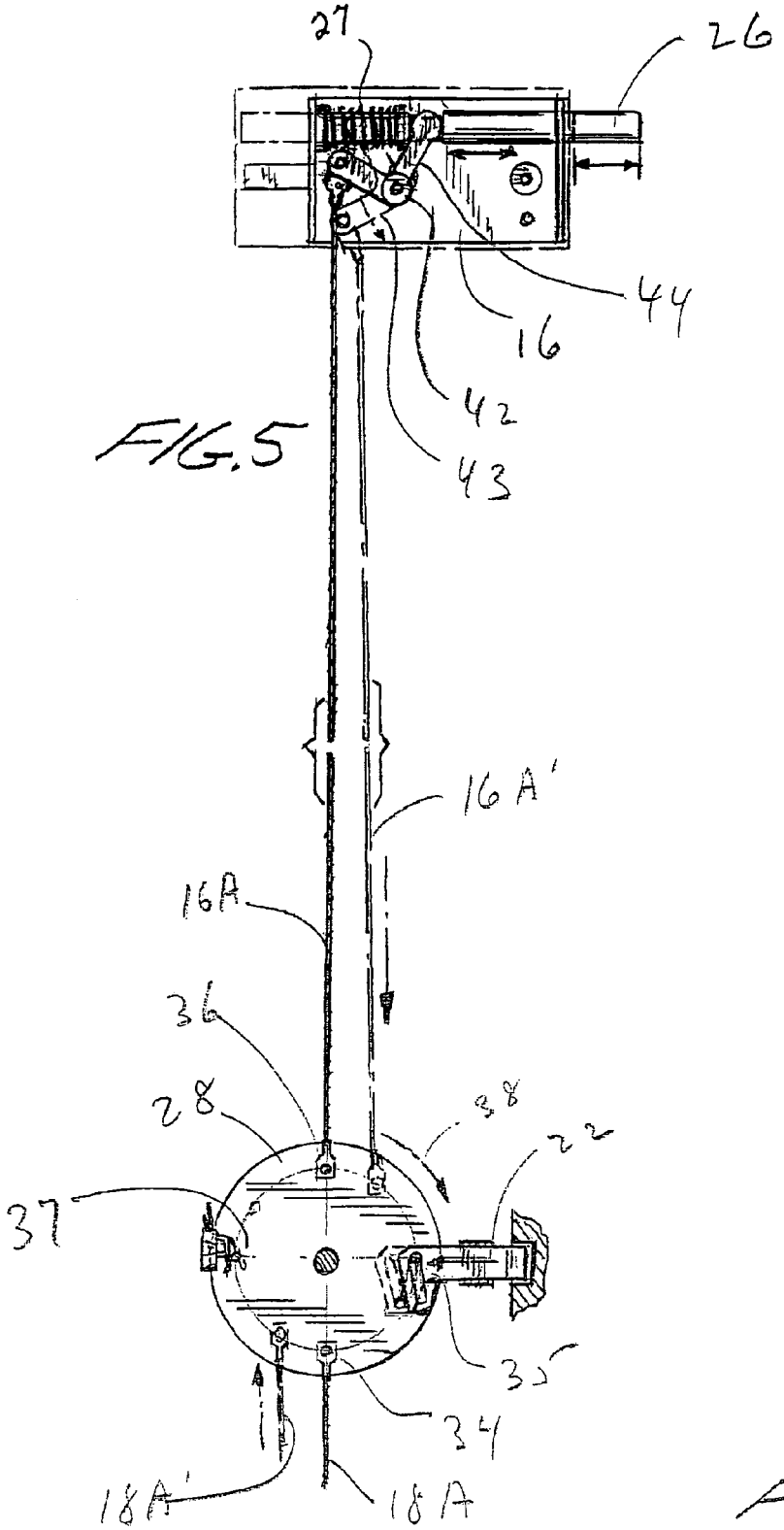
Figure 6:
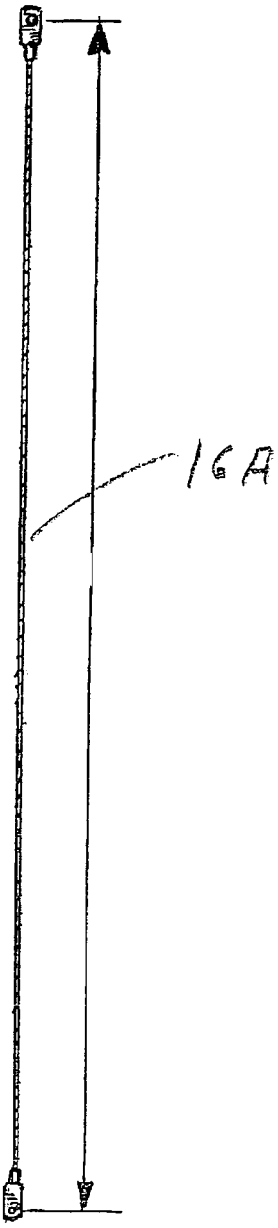
Figure 7:
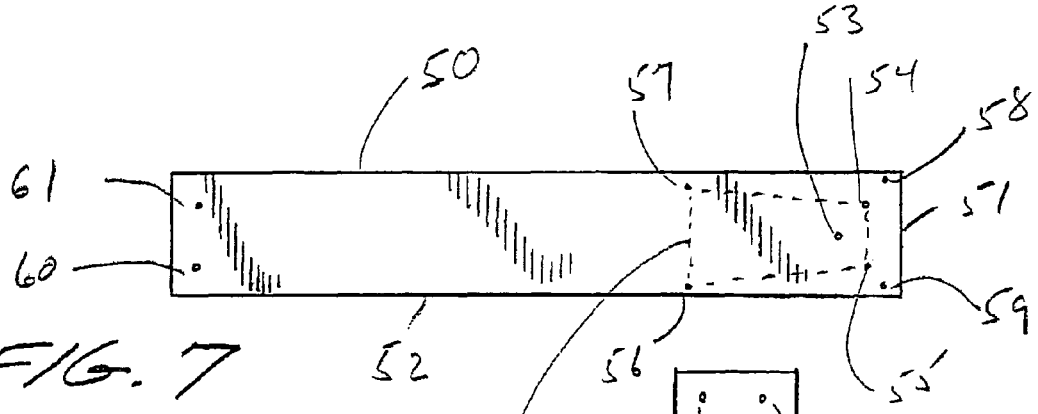
Figure 8:
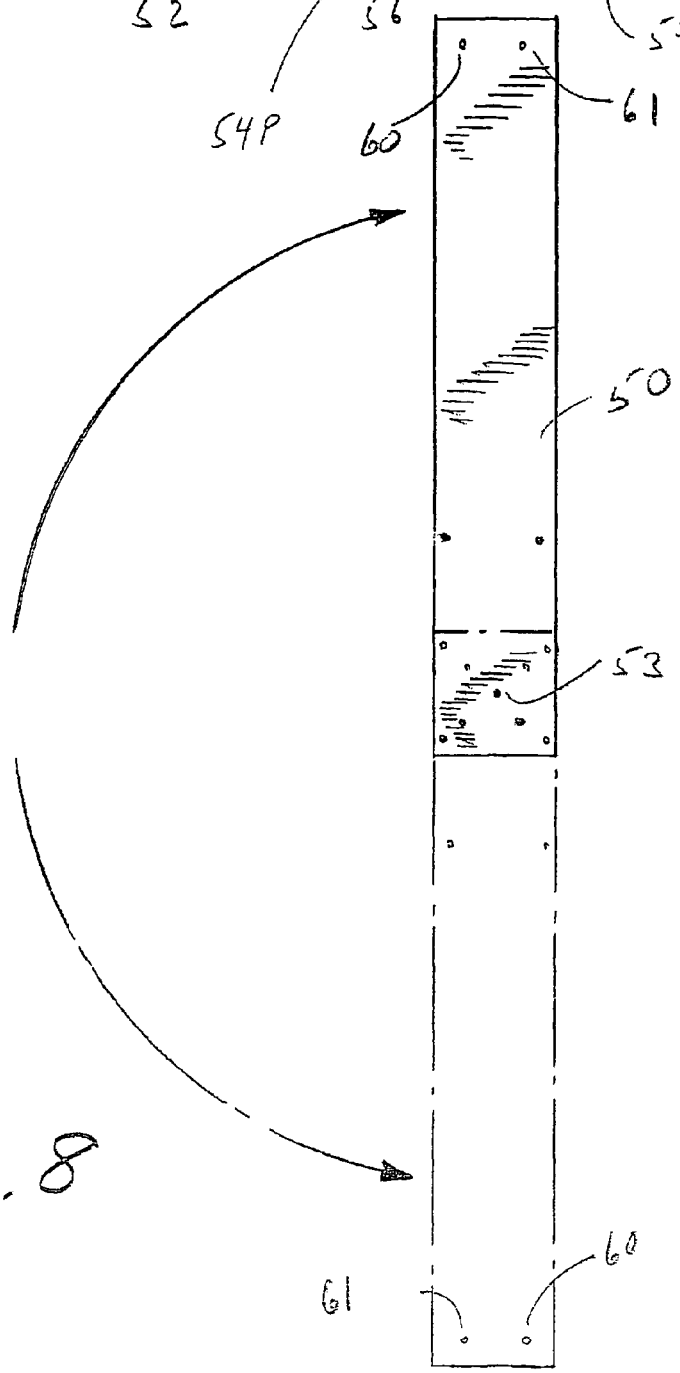
Figure 9:
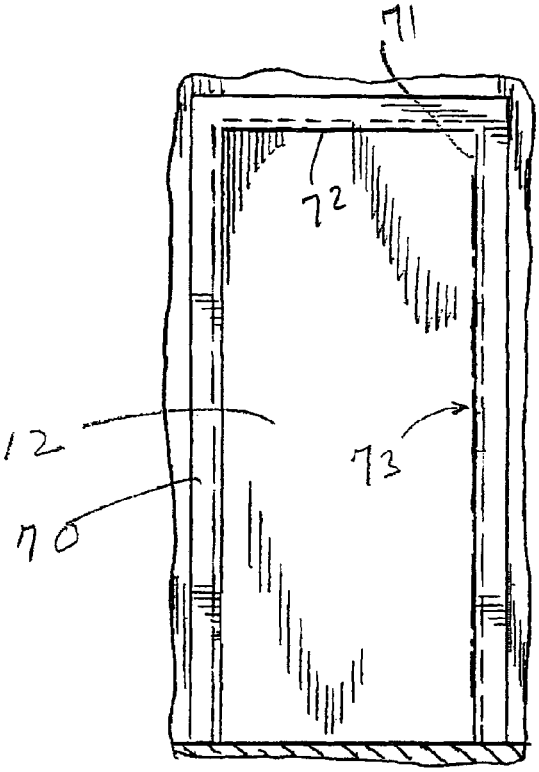
Figure 10:
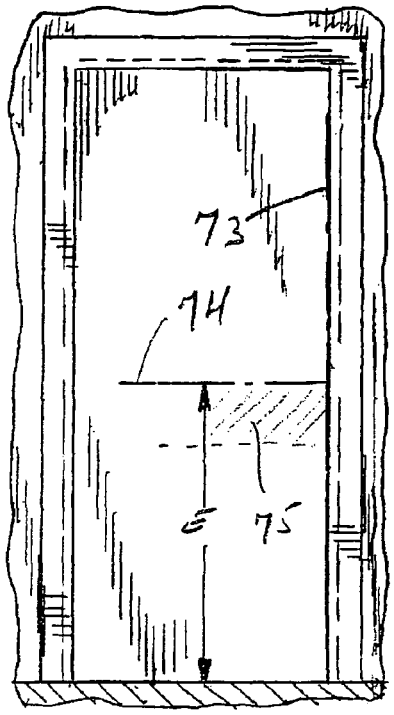
Figure 11C:
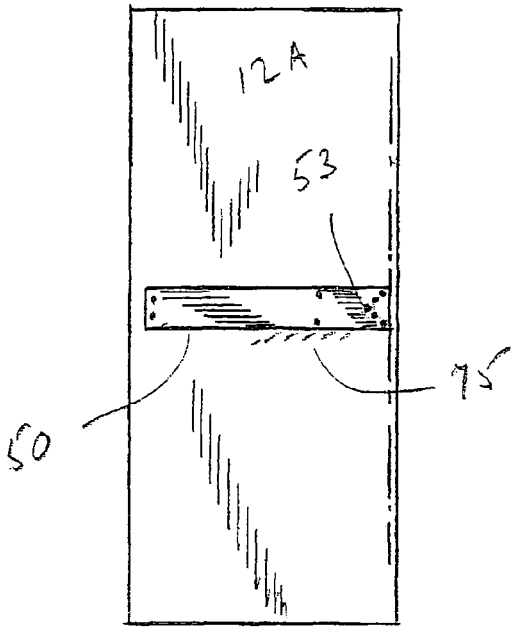
Figure 12:
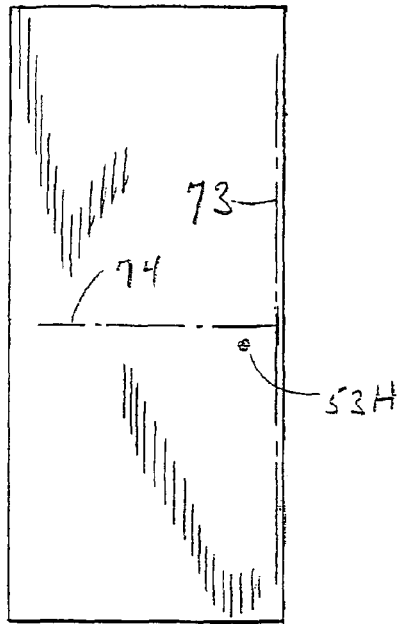

FIG. 1 is a fragmentary front elevation view of the new exit door lock mounted on the inside surface of a door, FIG. 2 is a fragmentary rear or sectional view of the new exit door of FIG. 1, FIG. 3 is a fragmentary sectional view taken along line 3-3 in FIG. 1, showing the paddle and the panic bar and motion translation member which converts linear motion of the panic bar to rotary motion and thence to linear motion of the deadbolt, FIG. 4 is a fragmentary elevation view section taking along line 4-4 in FIG. 3 showing the motion translation member of the main lock module, FIG. 5 is a fragmentary elevation view schematically showing the motion translation member of the main lock module coupled to the top lock module, FIG. 6 is a front elevation view of the tension cable coupling the main lock assembly with the top lock module, FIG. 7 is a front elevation view of the new installation template of the door lock assembly, FIG. 8 is a front elevation view of the installation template of FIG. 7 shown in its upward and downward vertical positions, FIGS. 9-16 are front elevation views illustrating the steps in the new method of installing the new exit door lock, where FIG. 9 shows the door before installation, FIG. 10 shows the horizontal reference line established, FIG. 11 shows positioning of the installation template along said horizontal reference line for drilling the principal pivot hole, FIG. 12 shows the door with the pivot hole bored therethrough, FIG. 13 shows the template installed in the horizontal position via a screw in said pivot hole, FIG. 14 shows the installation template rotated clockwise to its upward vertical position from that of the position shown in FIG. 13 for drilling top lock module mounting holes, FIG. 15 shows the installation template rotated counterclockwise 180° to its bottom vertical position for drilling installation holes for the lower or bottom lock module, FIG. 16 shows the door with the installation template removed and all of the installation holes established.

FIG. 17 shows the door with the main lock module mounted in its proper location and the upper and lower lock modules extending therefrom via there attachment cables but not yet mounted on door, FIG. 18 is an elevation view of the next step showing the upper and lower lock modules mounted to the door with the tension cables in straight or linear configuration, and FIG. 19 is an elevation view of the door and attached lock assembly of FIG. 8 with the deadbolts extended and engaging strike plates in the frame.

While the invention has been described in conjunction with several embodiments, it is to be understood that many alternatives, modifications, and variations will be apparent to those skilled in the art in light of the foregoing description. Accordingly, this invention is intended to embrace all such alternatives, modifications, and variations which fall within the spirit and scope of the appended claims.

D. DETAILED DESCRIPTION OF THE PREFERRED EMBODIMENTS

For convenience and clarity in describing these embodiments, similar elements or components appearing in different figures will have the same reference numbers.

FIGS. 1 and 2 show the new exit door lock 10 mounted on exit door 12, front surface 12A of door 12, the principal components of lock 10 being main lock module 14, top lock module 16, bottom lock module 18, top cable 16A, bottom cable 18A, protective channels 16B, 18B, panic bar or paddle 20, main lock module deadbolt 22 and top and bottom lock bolts 24, 26.

FIGS. 3 and 4 show schematically how pushing force F in the direction of arrow 21 causes axial or outward motion of panic bar 20 toward inner surface 12A of door 12. This force is applied to motion translation mechanism 23 which applies pulling forces F1, F2 and F3 to the lock bolts 22, 24 and 26 respectively. The mechanism shown in FIGS. 3 and 4 is known in the prior art, causing an internal element to slightly rotate because of the helical thread 23A on post 23B. Many alternative mechanisms are possible to produce pulling/withdrawing force on the lock bolts, including solenoids, other electrical, magnetic, hydraulic or mechanical systems.

One currently used motion and force translation mechanism is shown schematically in FIG. 5 where plate 28 is caused to rotate a few degrees by outward movement of a panic bar 20. Rotary plate 28 has pins 34-37 situated around its circumference and coupled to downstream cable and bolt components, as follows.

As seen in FIG. 5 pin 36 is coupled to cable 16A, so that clockwise rotation of plate 28 in the direction of arrow 38 pulls cable 16A to position 16A', which through top lock module 16 withdraws top bolt 24 from its extended and locked position. This bolt is spring biased to said locked position by spring 27. Similarly, pin 34, on rotation of plate 28 pulls cable 18A to position 18A', thence withdrawing spring-biased bottom bolt 26 via bottom lock module 18. Pin 35 (via a link not shown) withdraws bolt 22. Finally, pin 37 optionally couples to an alarm system for notifying a central or other office that this door has been opened. FIG. 5 further shows a bellcrank 42 in upper lock module 16 to drive top bolt 24.

FIG. 4 shows in more detail how cable 16A engages bellcrank 42 situated within top lock module housing 16. Bellcrank arm 43 is fixedly coupled to the top end of cable 16A which pulls bellcrank 42 counterclockwise. This moves bellcrank arm 44 counterclockwise which pulls and withdraws top bolt 24. The bottom lock module operates in substantially the same way.

As described earlier, and as illustrated in FIGS. 1 and 6, cables 16A and 18A are strong and essentially non-stretchable under the loads associated with this lock. Accordingly, when cables 16A, 16B are extended to be straight and taut, top and bottom lock modules 16, 18 will be at the exact predetermined distances D1,D2 respectively from main lock module 14. Thus, when the three lock modules are properly mounted in pre-drilled mounting holes (this to be described later), cables 16A, 18A will be straight and taut, and all bolts 22, 24, 26 will withdraw smoothly and reliably whenever panic bar 20 is pushed.

As described above, the new exit door lock 10 comprises main and top and bottom lock modules 14, 16, 18 and cables 16A, 18A, bolts 22, 24, 28 coupled to respective lock modules, panic bar 20 and motion translation members within each of the lock modules. Further, as described, cables 16A, 18A have predetermined fixed length with ends fixed to respective lock modules. The materials and manufacturing methods for making these components of lock 10 are well known in the prior art, with strength and environmental conditions affecting the selection of materials.

The second aspect of the present invention is the new method of installation of lock 10 as described herein. A principal element required in the new method is marking template 50 seen in FIG. 7 and in FIGS. 11, 13, 14 and 15. Template 50 in FIG. 7 includes drill holes and reference edges, as follows. Edges 51, 52 correspond to vertical and horizontal positioning reference lines on the door, to be described later. Hole 53 is a pivot hole about which template 50 rotates; holes 54-57 (defining trapezoidal pattern 54P) are for bolts to mount main lock module housing door 12; holes 58-59 are for bolts to mount the anti-pry plate 15 (see FIG. 2) on the outside surface of door 12 generally opposite main lock module 14; and holes 60, 61 are for bolts to mount top and bottom modules 16, 18.

The new method of installation proceeds as follows. Per FIG. 9, door 12 is closed onto door frame 70, door 12 being shown as outside the inner edges 71, 72 of frame 70 so that the door can pivot outward when opened. With door 12 closed as shown a vertical line 73 is marked on the door.

Per FIG. 10, horizontal line 74 is mark at a predetermined elevation E, which in this preferred embodiment is forty-five inches up from the floor. The space 75 shown by diagonal lines below and to the left of lines 73 and 74 is where template 50 will be positioned.

Per FIG. 11, template 50 is positioned at area 75, and a pivot hole is marked by a pencil or other marker inserted through hole 53 in the template onto door surface 12A. Per FIG. 12, template 50 is removed, a hole 53H is drilled into door 12 at the mark from template hole 53.

Per FIG. 13, template 50 is re-positioned onto area 75, and a screw is driven through hole 53 into the newly drilled hole. With template temporarily held in this horizontal position, per FIG. 13, holes 54-57 and holes 58-59 are marked through template 50 onto door 12; then per FIG. 14, template 50 is rotated clockwise upward and holes 60, 61 are marked for top lock module 16, and then per FIG. 15, template 50 is rotated about pivot screw 53 to again mark holes 60, 61 this time for bottom lock module 18. The steps of FIGS. 14 and 15 are illustrated more clearly in FIG. 8. Obviously, the sequence of positions of template 50 can be varied in any way. Per FIG. 16, with template 50 removed, all the marked holes are drilled to provide appropriate size mounting holes. From holes 53, 54-57, 58-59 and 60-61 in template 50 have been drilled corresponding holes 53H-61H in door 12.

Per FIGS. 17-19, lock modules 14, 16, 18 are bolted to door 12 via the respective holes that were drilled, at which time cables 16A, 18A are extended straight. Also, protective channels 16B, 18B are attached to cover, conceal and protect cables 16, 18. Per FIG. 19, strike plate 80 is mounted to the door frame and recess holes or additional strike plates are added adjacent top and bottom lock modules 16, 18 to the door frame. Other final and typical and conventional installation details are conducted as required.

A key aspect of the new lock is the pre-assembly of main and remote lock modules 14, 16, 18 with cables 16A, 18A of predetermined fixed lengths, with ends of cables 16A, 18A secured to the various lock modules at the time of manufacture, so that the installer receives a lock assembly of main and remote lock modules that requires no finding, analyzing and assembling of principal components. A key aspect of the new method of installation is the use of the new template 50 which is rotated to various positions for automatically and accurately locating all relevant drill holes of the separate lock modules. In the installation method illustrated the door frame establishes the easy-to-use reference line for the template used to locate all the mounting holes.

It should be apparent to a person of ordinary skill in the art that there exist a variety of mechanisms for converting the outward motion of the panic bar into forces to withdraw the various lock bolts, including solenoids, various electrical motors, hydraulics, etc. Also, the panic bar, while typically being a "push-out" type frequently required by regulations, could also be "push-down" or other type, and furthermore could be actuated in a variety of other ways.

Although the best mode for carrying out the present invention has been described in the foregoing detailed description and illustrated in the accompanying drawings, it will be understood that the invention is not limited to the embodiments enclosed, but is capable of numerous rearrangements, modifications and substitutions of steps and elements without departing from the spirit of the invention. Accordingly, the present invention is intended to encompass such rearrangements, modifications and substitutions of steps and elements as fall within the scope of the appended claims.

The invention claimed is:

1. A multi-point lock installable on an exit door that is mountable on a door frame and is moveable between closed and open positions, said multi-point lock comprising:

a. a main lock module comprising a main housing mountable on said exit door, a main lock bolt carried by said main housing and movable between its locked position where it engages said door frame and its unlocked position for allowing said exit door to open, and main drive means on said main housing for moving said main lock bolt between its locked position and its unlocked position, b. a remote lock module comprising a remote housing mountable on said exit door at a location vertically displaced from said main lock module, a remote lock bolt carried by said remote housing and movable between its locked position where it engages said door frame and its unlocked position for allowing said exit door to open, and a remote drive means on said remote housing for moving said remote lock bolt between its locked position and its locked position, c. a push panic bar that is coupled to said main drive means, mountable on said exit door and moveable from its closed to its opened position which activates said main drive means to drive said main lock bolt to its open position, and d. a flexible pull cable having opposite near and remote ends permanently fixed to said main and remote drive means respectively, said cable having pre-determined length such that there will be a corresponding predetermined distance between said main and remote housings when said cable is extended to be generally straight, said main and remote lock modules thus being mountable on said door at a predetermined distance between them without requiring any measurement between them, and e. whereby said push bar, when moved from its closed to its opened position, drives said main drive means to move said main lock bolt to its unlocked position and at the same time, pulls said pull cable whose remote end pulls and thereby drives said remote drive means to move said remote lock bolt to its unlocked position, so that said exit door can be opened.

2. A multi-point lock according to claim 1, further comprising a second flexible remote lock module having a second remote housing, a second lock bolt and second drive means, and a second flexible pull cable having near and remote ends permanently fixed to said main and second remote drive means respectively, said second flexible cable having predetermined length whereby said second flexible cable, when extended axially, establishes a pre-determined distance between said main and second remote housings, and said main drive means, when moved to its opened position, applying tension to both said flexible pull cable and said second flexible pull cable whose respective remote ends pull and thereby drive said remote and said second remote drive means to move said remote and said second remote lock bolts respectively at the same time to their respective unlocked positions.

3. A multi-point lock according to claim 2 wherein said main lock module drive means has upper and lower parts, and said flexible cable and said second flexible cable have respective near ends attached to said upper and lower parts respectively of said main drive means.

4. A multi-point lock according to claim 2, wherein said exit door has opposite inner and outer side surfaces and is pivotably mountable in said door frame to move in an outward direction from its closed position to its open position, and wherein said main and remote lock modules are mountable on said inner side surface of said exit door, and wherein said main drive means comprises a plate mounted for rotation about an axis extending transversely of said main drive means on said inner side of said exit door, said plate having top, bottom, left and right side parts, said top part engaged to said near end of said flexible cable, one of said side parts of said plate coupled to the main lock bolt, said bottom part of said plate coupled to said near end of said second flexible cable, and said other of said side parts coupled to said panic bar, whereby pushing of said panic bar causes rotation of said plate which causes said top and bottom parts as they rotate to apply tension to said cable and said second cable and to drive said remote and said second remote drive means to unlock said remote and said second remote lock bolts, rotation of said plate also simultaneously driving and unlocking said lock bolt of said main lock.

5. A multi-point lock according to claim 2, wherein said cable and said second cable each have equal length and said remote and said second remote modules are situated equidistant from said main lock assembly.

6. A multi-point lock according to claim 2 wherein said main lock module, said remote and said second remote lock modules and said flexible pull cable and second flexible pull cables coupling said main drive means and said remote and second remote drive means respectively of said first and second remote lock modules, comprise a pre-assembled lock system, wherein, upon installation on a door, said remote lock modules with their respective cables extended axially between said main and remote drive means respectively, will automatically be sited predetermined distances from said main lock module.

7. A multi-point lock according to claim 6 wherein said remote and said second remote lock modules each further comprises a spring which biases its respective remote lock bolt toward its locked position, and said flexible and said second flexible cable when pulled by said main lock module drive means, drive said remote and said remote drive means against said biasing springs to drive said remote lock bolts to their open positions respectively.

8. A multi-point lock according to claim 1 wherein said exit door has opposite inner and outer side surfaces and is pivotably mountable in said door frame to move in an outward direction from its closed position to its open position, and wherein said main and said remote lock modules are mountable on said inner side surface of said exit door.

9. A multi-point lock according to claim 8 wherein said panic bar is spaced apart from said inner side surface of said exit door and is movable in an outward direction toward said inner side surface of said exit door.

10. A multi-point lock according to claim 1 where said main lock module, said remote lock module and said flexible pull cable of pre-determined length whose ends are fixed to said drive means of said main and remote lock modules, comprise a pre-assembled lock system wherein, upon installation on a door, said remote lock module with said cable extended axially between said main and remote drive means respectively will automatically be sited a predetermined distance from said main lock module.

11. A multi-point lock according to claim 1 wherein said remote lock module further comprises a spring which biases said remote lock bolt toward its locked position, and said flexible cable when pulled by said main lock module drive means drives said remote drive means against said biasing spring to drive said remote lock bolt to its open position.

12. A multipoint lock adapted to be mounted on an exit door that is adapted to be mounted on a door frame, where said exit door is movable from its closed position to its open position, said lock comprising:

a. a main lock module, and remote lock module and second remote lock modules at locations vertically displaced respectively above and below said main lock module, each of said main, remote and second remote lock modules having a housing, a lock bolt movable in its housing, and drive means to move said respective lock bolt between its closed and open positions, each of said lock bolts having an end part for locking engagement with said door frame, b. two flexible pull cables, each having near and remote ends where said near of each of said cable is permanently fixed to said main lock drive means and said remote end of each of said cables is permanently fixed to one of said remote lock drive means, each of said cables having a predetermined length such that there will be a corresponding predetermined distance between said main and said two remote lock modules when said multi-point lock is mounted on an exit door with said cables extended to be generally straight, c. said main lock module further comprising an activation element coupled to said main lock drive means and movable between its closed and open positions, d. whereby, in said multi-point lock, when mounted on an exit door with said flexible pull cables extended to be generally straight and said lock bolts in their locked positions engaged to said door frame, movement of said activation means from its closed to its open position moves said main lock drive means which simultaneously (a) moves said main lock bolt to its open position, and (b) applies tension to both of said flexible pull cables which causes said two remote drive means to move their remote lock bolts to move to their respective open positions, so that said exit door can be opened.

13. A multi-point lock according to claim 12, wherein said activation element is push panic bar adapted to be mounted on said exit door, said push panic bar having a locked position where it is spaced from said door and being movable in said outward direction to its open position for driving said drive means of said main lock module to its open position which drives said lock bolts of all said lock modules to their respective open positions.

14. A multi-point lock according to claim 12, wherein said flexible cable and said second cables are of equal predetermined length so that said remote and said second remote lock modules will each be spaced from said central lock module by the same predetermined distance when mounted on said exit door with said cables extended straight.

15. A multi-point lock according to claim 12, wherein said main lock module drive means is a rotatable element having upper and lower parts coupled to said near ends of said upper and lower cables respectively, and has left and right parts coupled to said panic bar and said lock bolt respectively, so that movement of said panic bar drives said element to rotate, and said element when rotated drives all of said locking bolts at the same time.

16. A multi-point lock according to claim 12, wherein said activation element comprises a push panic bar that is movable generally axially between its closed and open positions, coupled with a motion translation member (MTM) that converts said generally axial motion to rotary motion, whereby said MTM is coupled to said main lock bolt and to said near ends of said cables, and said generally axial motion of said push bar rotates said MTM and drives said lock bolts to their open positions.

17. A multi-point lock according to claim 12, wherein, in said main lock module, said main lock bolt is a dead bolt, and in each of said remote lock modules said lock bolt is spring biased to its locked position.

18. In combination, a multi-point lock according to claim 12 and an exit door that has opposite inner and outer sides and is pivotable in a door frame when pushed in an outward direction from its closed to its open position, said inner side having central, upper and lower parts, said lock mounted on said inner side with said main lock module mounted on said central part and said upper and lower lock modules mounted on said upper and lower parts and respectively spaced apart from said central lock module said predetermined distance, with said flexible cable and said second cable of said predetermined length extended in a generally straight configuration between said main lock module and said remote lock modules respectively.

19. A multi-point lock kit for use with an exit door that is mountable on a door frame and is moveable between closed and open positions, said multi-point lock kit comprising:

a. a main lock module comprising a main housing mountable on said exit door, a main lock bolt carried by said main housing and movable between its locked position where it engages said door frame and its unlocked position for allowing said exit door to open, and main drive means on said main housing for moving said main lock bolt between its locked position and its unlocked position, b. remote lock module comprising a remote housing mountable on said exit door at a location vertically displaced from said main lock module, a remote lock bolt carried by said remote housing and movable between its locked position where it engages said door frame and its unlocked position for allowing said exit door to open, and a remote drive means on said remote housing for moving said remote lock bolt between its locked position and its locked position, c. a push panic bar or paddle that is coupled to said main drive means, mountable on said exit door and moveable from its closed to its opened position which activates said main drive means to drive said main lock bolt to its open position, d. a flexible pull cable having opposite near and remote ends, and fixed to said main and remote drive means respectively, said cable having pre-determined length whereby said first cable, when extended axially, establishes a pre-determined distance between said main and first remote housings, whereby said push panic bar, when moved from its closed to its opened position, drives said main drive means to move said main lock bolt to its unlocked position and at the same time, pulls said pull cable whose remote end pulls and thereby drives said remote drive means to its unlocked position, so that said exit door can be opened.

20. The multi-point lock kit according to claim 19 further comprising a second flexible remote lock module having a second remote housing, a second lock bolt and second drive means, and a second flexible pull cable having near and remote ends permanently fixed to said main and second remote drive means respectively, said second flexible cable having pre-determined length whereby said second flexible cable, when extended axially, establishes a pre-determined distance between said main and second remote housings, and said main drive means, when moved to its opened position, applying tension to both said flexible pull cable and said second flexible pull cable whose respective remote ends pull and thereby drive said remote and said second remote drive means to move said remote and said second remote lock bolts respectively at the same time to their respective unlocked positions.

* * * * *